US005390461A

United States Patent [19]

Dwyer

[11] Patent Number: 5,390,461

[45] Date of Patent: Feb. 21, 1995

[54] COFFERED SUSPENDED CEILING STRUCTURE FOR A THREE DIMENSIONAL GRID

[75] Inventor: Austin A. Dwyer, 1302 Hoyt Ave.; Everett, Wash.

[73] Assignees: Austin Dwyer; Dale Cohen, both of Everett, Wash.

[21] Appl. No.: 911,284

[22] Filed: Jul. 9, 1992

[51] Int. Cl.[6] ..... E04B 9/00

[52] U.S. Cl. ..... 52/506.03; 52/506.06

[58] Field of Search ..... 248/343; 362/150, 355; 52/28, 311.1, 484, 485, 488, 506.03, 506.06

[56] References Cited

U.S. PATENT DOCUMENTS

| | | | |
|---|---|---|---|
| 3,336,471 | 8/1967 | Milner | 362/355 |
| 3,581,448 | 6/1971 | Roux | 362/150 |
| 4,189,888 | 2/1980 | Blitzer | 52/311.1 |
| 4,272,804 | 6/1981 | Blum | 248/343 |
| 4,414,617 | 11/1983 | Galindo | 52/28 |

FOREIGN PATENT DOCUMENTS

| | | | |
|---|---|---|---|
| 1176855 | 11/1958 | France | 362/148 |

*Primary Examiner*—James L. Ridgill, Jr.

*Attorney, Agent, or Firm*—Gregory W. J. Hauth

[57] ABSTRACT

A ranged, hollow, coffered rectilinear structure having integrally joined side member for hanging within a conventional, suspended T-bar subceiling matrix. Optionally the rectilinear structure may have a lip beneath the flange so that when two side members of two structures sit opposite one another on a conventional T-bar rail, both side members cooperate to reveal a space beneath the T-bar for mounting an additional track assembly, such track lighting, to the T-bar rail. Cross members in the hollow rectilinear structure add to its aesthetic appeal. A single cross member bisecting the rectilinear structure is formed so that it may be split, creating two smaller rectilinear structures having uniformly shaped, flanged side members for hanging within smaller T-bar matrices. By modifying the T-bar matrix and the rectilinear structure, a 3-Dimensional T-bar matrix is formed in the suspended ceiling, allowing rectilinear structures to be oriented on each other in both the horizontal and vertical planes. This allows for certain 3-Dimensional configurations, such as a cubical structure, to be made within a suspended ceiling framework.

3 Claims, 4 Drawing Sheets

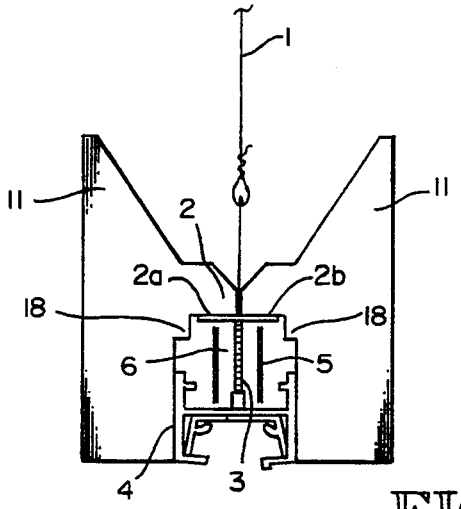
FIG. 3
FIG. 4
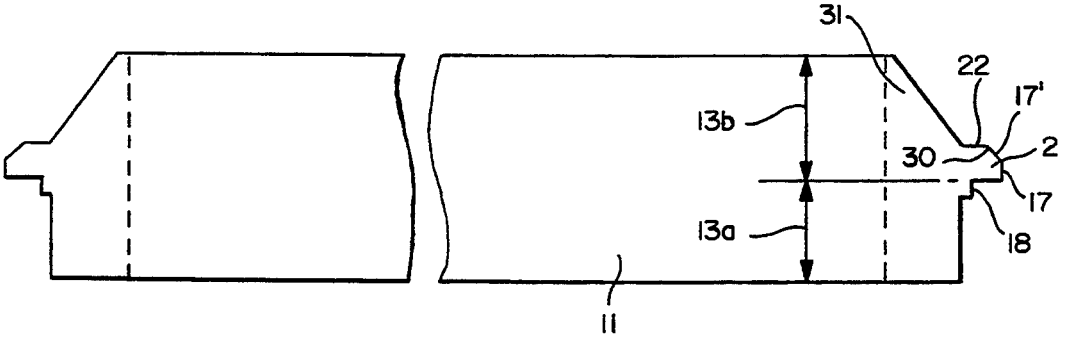

FIG. 7
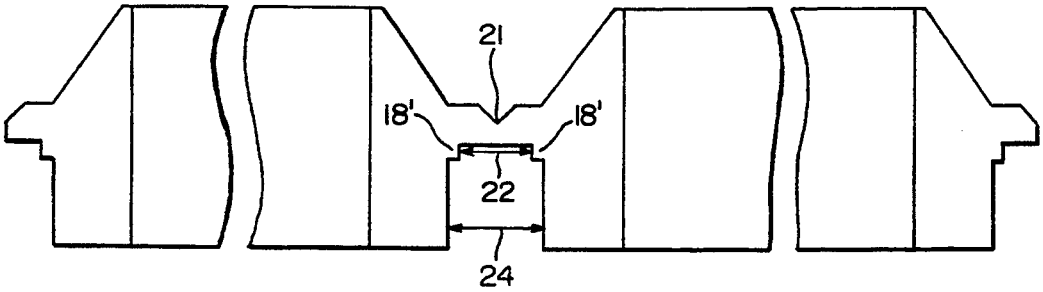
FIG. 8
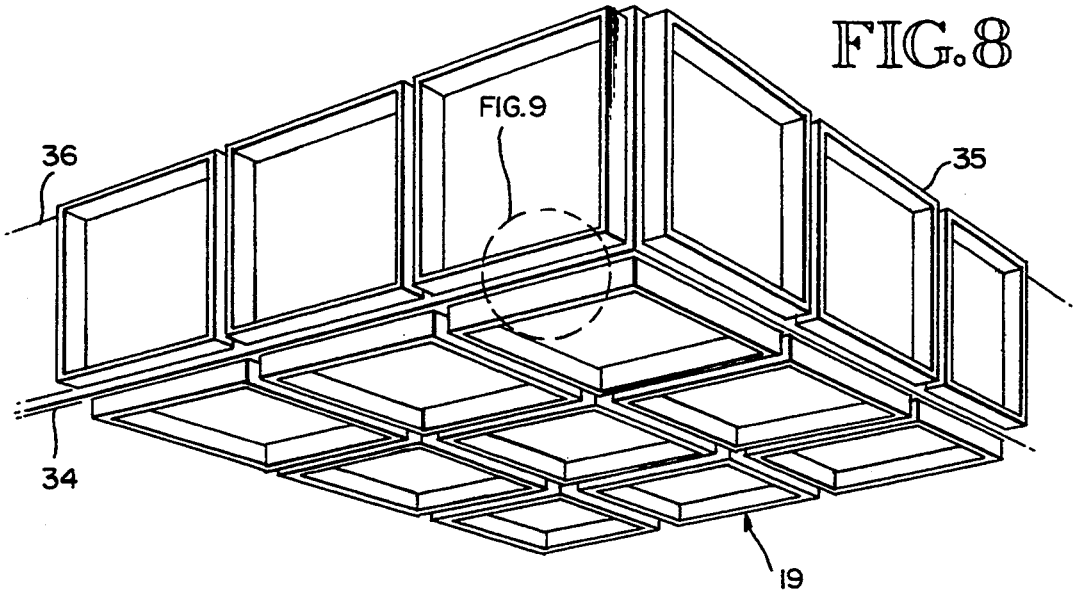
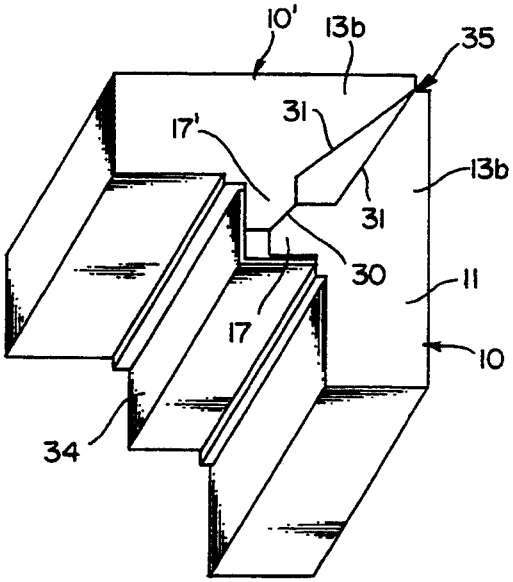
FIG. 9

COFFERED SUSPENDED CEILING STRUCTURE FOR A THREE DIMENSIONAL GRID

FIELD OF THE INVENTION

This invention relates to the filed of subceilings of the type having square or rectilinear panels supported in a suspended matrix of inverted T-bar rails forming a grid pattern. More particularly, this invention relates to a hollow rectilinear structures formed so as to provide a coffered ceiling, to optionally allow the T-bar rail to accommodate an additional track assembly, to split a larger rectilinear structure into two smaller rectilinear structures, or to form a 3-Dimensional, suspended grid pattern, such as a cube.

BACKGROUND INFORMATION

Suspended ceilings are well known in the art. Employed in most newer construction buildings and, particularly, in commercial construction, it is most common to hang a suspended ceiling such that various venting, heating, air conditioning, electrical, telephone, and other wiring and duct work may be located between the suspended ceiling and the natural ceiling of the building.

In the construction of suspended ceilings, the use of an inverted T-bar rail has become common. The T-bar rail is suspended from its vertical component from the natural ceiling of the building structure. The T-bar rail, when inverted, also has horizontal components which serve as longitudinal flanges, or half-planes, extending in a co-planar fashion and at fight angles to the plane of the vertical component of the T-bar rail. A plurality of T-bar rails are suspended from the natural ceiling at an appropriate distance to form a matrix having main runner members generally parallel to each other, and cross runner members generally parallel to one another and perpendicular to the main runner members. After a suitable matrix of T-bar rails have been suspended from the natural ceiling therefrom a multiplicity of rectilinear panels are positioned on the extended half-planes of the T-bar rails. This produces the familiar grid-like pattern of ceiling panels that characterize essentially all suspended ceilings. While many suspended T-bar rails form a grid pattern in a conventional 2'×4' rectangle, some T-bar rails are established in a 2'×2' square configuration. The basic functional form of such subceilings is shown, for example, in U.S. Pat. No. 3,977,144, where the bottom surfaces of the rail flanges are left exposed as flat boundary strips between edge-supported panels. Commonly-used inverted T-bar rails have become dimensionally standardized to produce either a 2'×4' matrix or a 2'×2' matrix.

To enhance the aesthetic appeal of such grid patterns of suspended ceilings, certain steps have been suggested. In the first instance, the outer or downward facing component of each inverted T-bar element may be colored to provide a suitable contrast or complement to the colors of the panels held between the T-bar rail. Also, the prior art indicates that a broad variety of ornamental designs of the panels (which also serve an acoustical function) can be achieved. Other prior art (U.S. Pat. No. 4,747,246) discloses a means for the attachment of a false or imitation beam structure to a suspended ceiling, U.S. Patent No. 4,848,054 discloses hollow beams designed to attach to the bottom horizontally extending portion of a T-bar rail, similar to the beams disclosed in U.S. Pat. No. 4,747,246 discussed above. The beams may be made from plastic and are sized and configured to provide a visual depth to the ceiling. U.S. Pat. No. 3,685,238 also attempts to achieve visual depth by disclosing metal coffers which hang by wires from a ceiling structure. U.S. Pat. No. 3,153,304 discloses the use of a flange to support suspended ceiling panels. However, none of these patents or other references in the prior art disclose or suggest the combination of an integral, rectilinear structure having a hollow interior, supported on a T-bar rail by flanges, and sized to hang down from the T-bar rail a relatively large distance so as to produce a coffered, aesthetically appealing view of depth to the ceiling. The prior art also fails to anticipate the invention's inclusion of at least one cross-member which adds to the structure's visual appeal by converting a larger grid opening (of 2'×4' dimensions) to a smaller grid opening (of 2'×2' dimensions). This adds to the sense of visual appeal and sense of intimacy afforded by the coffered suspending ceiling of the present invention.

Further, these references fail to suggest the further modifications disclosed by the present invention of building three dimensional grid patterns (such as a cube) from a plurality of structures suspended both vertically and horizontally in the ceiling.

Finally, no suggestion is made in the prior art for forming a lip beneath the flanged side member of the structure as a means to reveal a rectilinear space, centered beneath the T-bar rail, for mounting an additional track assembly, such as track lighting, beneath the T-bar rail so as to fit flush within, or between, opposing side members being supported by, and hanging below, the T-bar rail.

SUMMARY

It is an object of the present invention to provide a hollow rectilinear ceiling structure for suspension by a conventional T-bar matrix. Each structure hangs down sufficiently far so that a plurality of these structures suspended within a conventional T-bar matrix forms a grid which creates a coffered suspended ceiling. The invention is supported on conventional, inverted T-bar rails by a flange running the length of each side member of the rectilinear structure, the flange being sized to engage substantially all of the horizontally protruding half plane of a conventional T-bar rail. Beneath the flange is an additional lip providing sufficient space beneath a T-bar rail to introduce an additional track assembly for mounting to the T-bar rail, for example, to mount track lighting within the ceiling structure. In another embodiment, at least one cross member may be placed within the hollow structure to form a geometrical lattice. In yet another embodiment, only one, symmetrically shaped, bisecting cross member bisects the structure so as to give the appearance of two smaller, equally sized structures which remain joined as a single structure. The bisecting cross member can be shaped symmetrically, to comprise two faces of two side members. Additionally, the bisecting cross member may contain a means for separating the bisecting cross member along its length to allow the single hollow structure to be separated into two smaller, equally sized structures. The bisecting cross member may also be separated or cut so that, when it is separated to form two smaller structures, each smaller structure contains the aforementioned flange running along the side formed from separating the bisecting cross member. The bisecting cross member may further be shaped so that, after the bisecting cross member is separated along the notch to create two smaller structures, beneath the flange of each smaller structure produced from the separation is an additional lip providing sufficient space beneath a T-bar rail to introduce an additional track assembly for mounting to the T-bar rail. This additional track assembly can be mounted to, and directly beneath, the T-bar rail, and can be used to support additional structures from the ceiling, such as track lighting or other items. The rectilinear space allows for the additional track assembly to mount flush with the surrounding structures of the present invention for a smooth, appealing appearance.

Another object of the invention is to create a 3-Dimensional T-bar matrix, such as a cube in a suspended ceiling system. The 3-Dimensional matrix requires that the standardized T-bar grid structure is changed so that the T-bar rail having horizontally extending half-planes be replaced with an angled T-bar. Further, the structure must be fitted to have both lower and upper runner members for maintaining a rectilinear structure in a vertical plane within the 3-Dimensional matrix. The rectilinear structure of the present invention must also be changed by introducing a mitered seating surface in the flange, and a second mitered, obtusely angled upper half face of the side member. These changes in the rectilinear structures of the present invention allow a horizontally suspended rectilinear structure to support, and seat, a vertically oriented rectilinear structure within a 3-Dimensional T-bar frame matrix so that a plurality of rectilinear structures oriented both horizontally and vertically to produce a 3-Dimensional, coffered, suspended ceiling. The upper runner member may be an angled T-bar rail or a conventional (inverted) T-bar rail. Preferably, the 3-Dimensional suspended ceiling is also coffered, having a projection depth of the rectilinear structures from 3 to 7 inches. As in the standard T-bar rectilinear structure, the rectilinear structures of the 3-Dimensional T-bar matrix should engage, at the flange, substantially all of the angled 7-bar rail. And, the side members of the 3-Dimensionally configured rectilinear structure should also have an additional lip providing sufficient space beneath a T-bar rail to introduce an additional track assembly for mounting to the T-bar rail. Also, the rectilinear structure of the 3-Dimensional matrix may have at least one cross member to define a lattice structure, or have only one bisecting cross member. As was the case with the bisecting cross member described for the rectilinear structure fitting a standardized, horizontal, T-bar matrix, the cross member for a 3-Dimensionally configured rectilinear structure essentially comprises two, joined half faces of two side members, thereby forming a symmetrically shaped bisecting cross member which may be separated along its length to create two smaller, rectilinear structure. The separated structures may further have the mitered seating surface in the flange and mitered upper half face necessary to fit within the 3-Dimensional T-bar matrix. The bisecting cross member optionally contains a lip beneath it so that side members produced by separating the cross member may, when horizontally situated within the 3-Dimensional T-bar matrix on convention T-bar rails, accommodate an additional track assembly.

Finally, methods for making the rectilinear structures described herein and 3-Dimensional matrix system are presented.

The aforesaid objects of the invention and other objects and advantages which hereinafter appear may fully be understood from a study of the following detailed description taken in connect on with the accompanying drawings which are illustrative of preferred embodiments of the invention. It is understood, however, that the invention is not restricted to a strict conformity with the showing of the drawings but may be changed and modified as long as such changes make no mate departure from the salient features of the invention as expressed in the appended claims.

BRIEF DESCRIPTION OF THE DRAWINGS

FIG. 3 is a close up of the side members of 2 hollow rectilinear structures seated by their respective flanges on a conventional horizontal T-bar rail. FIG. 3 further shows a lip beneath each flange of each side member revealing a rectilinear space sufficiently wide for accepting a track lighting assembly for mounting beneath the T-bar rail.

FIG. 4 shows a detailed view of a side member of a rectilinear structure.

FIG. 7 shows the bisecting cross member as viewed from one end.

FIG. 8 shows a plurality of hollow rectilinear structures arranged in both horizontal and vertical planes so as to create a 3-Dimensional, cubical suspended ceiling structure and FIG. 8 includes a circle over a section of the 3-Dimensional cubical suspended ceiling structure, wherein the area within the circle denotes a section cut of two rectilinear structures within the 3-Dimensional structure, the section cut shown in greater detail by FIG. 9.

FIG. 9 shows a section cut rotated to show an end view of two rectilinear structures of a 3-Dimensional suspended ceiling of the preferred embodiment structure as shown in FIG. 8, and shows an angled T-bar rail necessary for accommodating the two rectilinear structures in perpendicular planes to one another.

DETAILED DESCRIPTION

Figure 1:
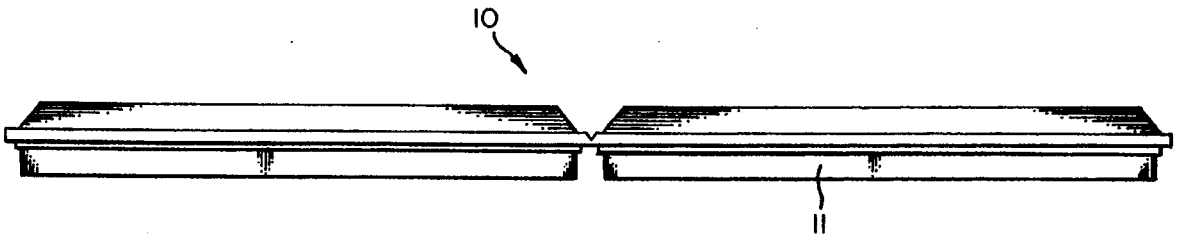
FIG. 1 is a side view of a 2'×4' rectilinear structure of the preferred embodiment having a symmetrically shaped bisecting cross member.
Figure 2:
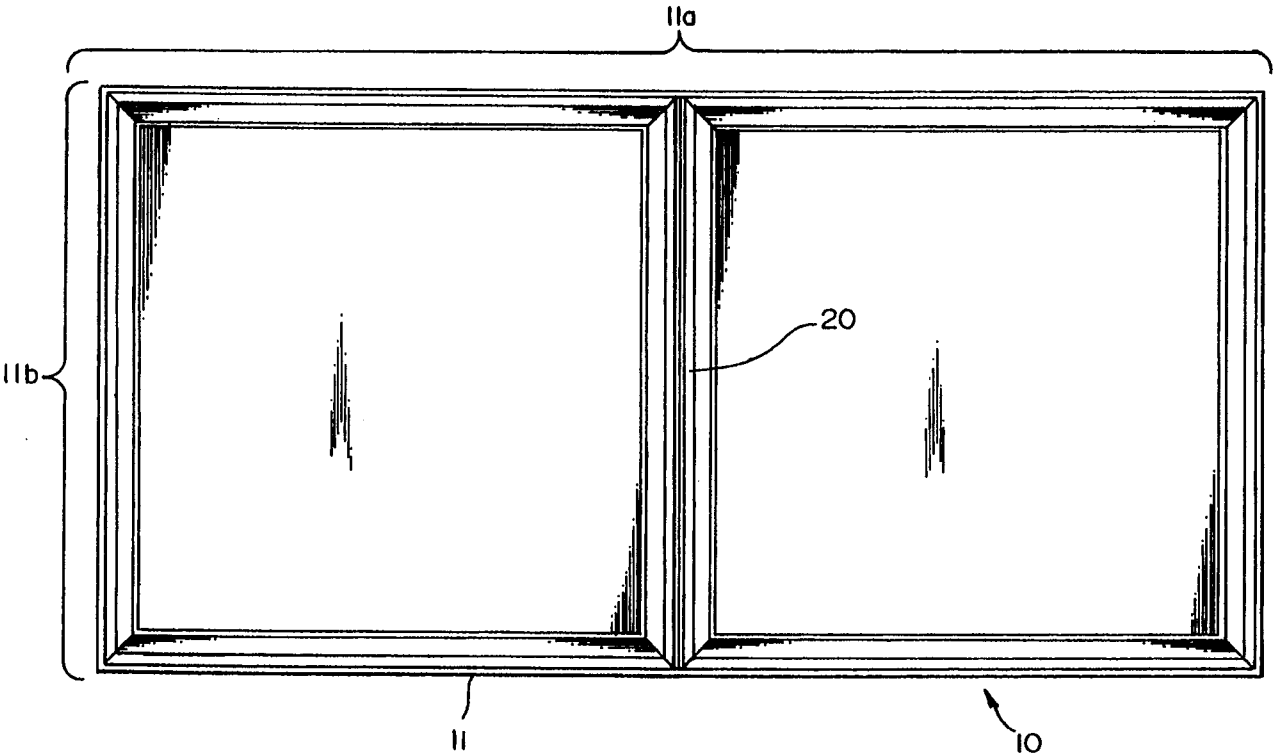
FIG. 2 shows a 2'×4' hollow rectilinear structure of the preferred embodiment viewed looking down onto the structure, having a symmetrically shaped bisecting cross member, giving the appearance of two 2'×2' structures joined in a 2'×4' grid.

Turning to the detailed description of the present invention, FIG. 1 shows a side view of the invention while FIG. 2 views the invention looking down at it in its preferred embodiment 10 comprising four side members 11 integrally formed together to create a hollow rectangle in a 2'×4' structure. As used herein, "hollow" refers to a vacant space within the area defined by the four integrally formed side member making up the rectilinear structure. A hollow structure offers certain optional advantages, such as allowing for lighting to be placed within the hollow space formed by the rectangle. A plurality of hollow structures in the ceiling grid such as that of the present invention also allow uninhibited penetration of fire sprinkler systems located above them.

Optionally, the four side members could be formed together to create a hollow square, such as in a 2'×2' structure. It should be apparent to those skilled in the art that the dimensions of the rectilinear structure of the present invention are not limited to a 2'×4' structure or a 2'×2' structure. Rather, the dimensions of the invention are chosen to conform to the dimensionally standardized configurations presented by T-bar rail matrices in suspended ceilings. Thus, the invention's dimensional configurations are not limited to current dimensionally standardized T-bar rail construction, but are also intended for variations from the standard, or to anticipate new dimensional standards, such as a metrically standardized T-bar rail matrix.

Construction of the side members into the integrally formed rectilinear structure may be accomplished through a variety of construction techniques known to those skilled in the art. The side members may be constructed individually and then integrally fastened together. FIG. 2 depicts four side members 11 formed together so as to create an integral, hollow rectilinear structure 10. A pair of side members 1 la join with a pair of side members 11*b* to create a hollow rectilinear structure, shown by FIG. 2. In the preferred embodiment, side members 11 are formed together in a mold of polystyrene, making an integral rectilinear structure upon initial formation. In the preferred embodiment, fire rated expanded polystyrene is used to produce the molded shape of the rectilinear structure. This material was chosen for its safety features of being fire resistant and because its light weight lessens the probability of causing injury should the ceiling structure fall or shake loose, as may happen during an earthquake. The polystyrene material used in the preferred embodiment of the structure was also chosen for its relatively low cost compared to traditional building material and its ability to be molded into a specific, integral shape having a substantial amount of material without being encumbered by weight or shape. Those skilled in the art can appreciate the ability to substitute polystyrene for other available construction foams, or for producing the disclosed structures from materials made of wood or even metal shapes.

FIGS. 3 and 4 show the cooperation between the ranged side members 11 of the invention and the T-bar rail. FIG. 3 shows a conventional T-bar rail 2 being supported by a cable 1. The T-bar rail 2 has horizontally protruding components for supporting each of two suspended ceiling structures 10. More specifically, the horizontally protruding components of the T-bar rail consists of two half-planes 2a and 2b. As shown in FIG. 4, a flange 17 extends from an outer face 13 of each side member 11. The flange 17 extends along the entire length of each side member 11, as shown in FIG. 1, so as to engage the T-bar rail along the outer side 13 of any side member 11. FIG. 3 shows each of two opposing side members 11 supported by each side member's flange 17 on each half-plane of a conventional T-bar rail 2. Preferentially, the flange 17 is sized to occupy substantially all of the half-plane 2*a* or 2*b* of the T-bar rail on which it rests.

In order to achieve an aesthetically pleasing appearance, that is, an appearance of depth, the structure should be coffered. The structure is sized so as to project below the T-bar rail to achieve the desired coffered appearance. Outer face 13 of side member 11 is further shown in FIG. 4 as having a lower half face 13*a* and an upper half face 13*b* when oriented so as to rest horizontally on a T-bar rail. The desired coffered appearance of the present invention is achieved by sizing the side members 11 so that the lower half face 13*a* extends below the flange 17 sufficiently far to create a coffered appearance. Preferably, lower half face 13*a* extends from 3 to 7 inches.

Figure 5:
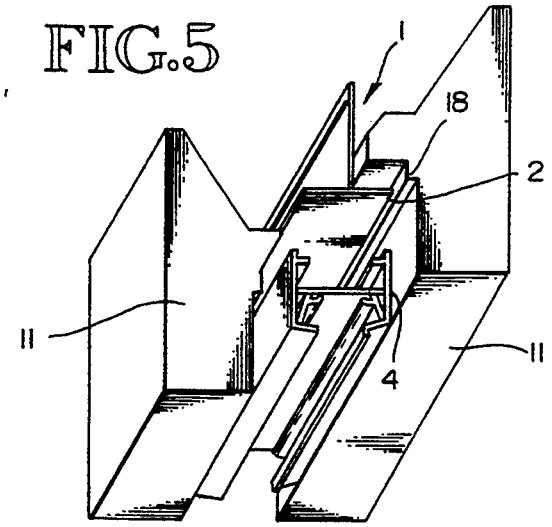
FIG. 5 shows a view of the T-bar rail and two rectilinear structures having lips beneath their seating flanges for accommodation of a track assembly.

To add to the structure's functionality and aesthetic appeal, the invention should not detract from the ability of the conventional T-bar rail to lend further support to other structures. Typically, T-bar rails are used to support molded plastic or metal tracks. A track may be mounted beneath a T-bar rail using a spacer and symmetrical screw, as is well known in the art. These tracks are further used to providing seating and support to light fixtures, commonly known as "track lights" within the suspended ceiling structure. Those skilled in the art will appreciate the ability to mount other devices to a track or to the T-bar rail. However, dimensionally standardized tracks for track lighting fixtures are typically wider than the T-bar rail itself. The inventor thus saw a need to modify the present invention to allow it to accommodate the additional width of a track having a spacer and mounting screw, or track assembly. FIG. 3 describes the present invention's accommodation of a track assembly. The additional track 4 of the track assembly mounts to the T-bar rail 2 by a spacer 5 and mounting screw 6. A lip 18 beneath flange 17 is formed in the side member 11 to create a rectilinear space beneath flange 17. When two opposing rectilinear structures 10 are seated on respective half-planes 2*a* and 2*b* of a common T-bar rail, the opposing lips 18 of both side members 11 cooperate to form, or reveal, a rectilinear space sufficiently wide to receive a track assembly for mounting directly to and beneath the T-bar rail. Each lip 18 is equally sized to present a space centered beneath the T-bar rail. Sizing of each lip is chosen to be wide enough to receive the track assembly while also maintaining a flush fit of the assembly to the lower half face 13*a* of each opposing side member 11, as is also shown in FIG. 5.

Figure 6:
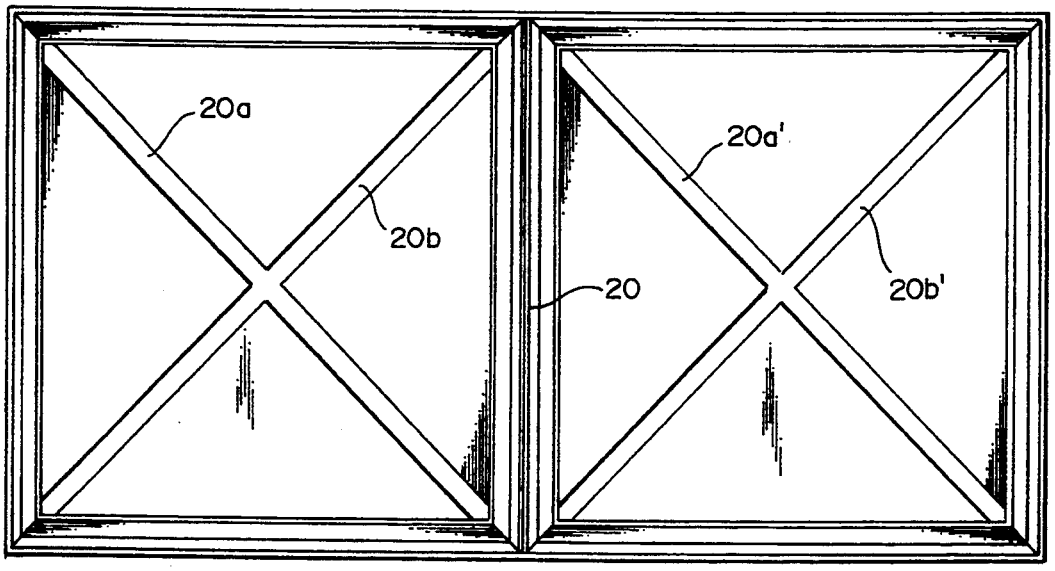
FIG. 6 shows the hollow rectilinear structure having multiple interior cross members forming a geometric lattice shape.

Variations in the appearance of the hollow rectilinear structures may be achieved by adding interior cross members within the hollow space of the structure. As shown in FIG. 6, additional interior cross members within the structure can be used to create new geometrical shapes, such as a lattice, within the basic hollow rectilinear structure of the present invention.

Use of a single cross member offers unique options for the manufacture and use of the rectilinear structure of the invention. FIG. 2 shows a single bisecting cross member 20 bisecting two of the side members. The bisecting cross member 20 is chosen to bisect the pair of side members having the longest length in the rectilinear structure. For example, in the rectilinear 2'×4' structure of the preferred embodiment, the two side members being bisected each measure 4 feet in length. The bisecting cross member 20 thus converts a 2'×4' structure into a 2'×4' grid essentially comprising two unified 2'×2' structures, giving greater visual appeal to a standard 2'×4' T-bar rail system. The bisecting cross member is integrally fixed to each side member and spans across the interior area defined by the hollow rectilinear structure.

In the preferred embodiment, the present invention is manufactured to be suspended within a 2'×4' T-bar matrix and includes a bisecting cross member 20 which additionally offers a notch 21, shown in FIG. 7, centrally positioned on either the upper or lower face of the cross member and running the length of the cross member. If the 2'×4' structure is to be used in a suspended ceiling which has a 2'×2' T-bar grid, the bisecting cross member can be easily separated, or split, along the length of the notch, thereby creating two equally sized and flanged structures for immediate installation in the smaller 2'×2' T-bar matrix. This notch, or other means for separating the bisecting cross member lengthwise, thus makes it possible to manufacture a single sized structure of 2'×4' dimensions, and then separate it along the bisecting cross member into two smaller 2'×2' structures on site at the installation as needed.

Separating the bisecting cross member creates two new side members in each of the newly formed smaller structures. Thus, each new side member 11 must also have a flange 17 for suspending the new structure in the T-bar matrix. To accomplish this, the bisecting cross member must be formed symmetrically to essentially comprise two individual, opposing, ranged side members, wherein the two side members are commonly joined at the tips of each side member's flange to form the symmetrically shaped bisecting cross member. FIG. 7 provides a view of the bisecting cross member looking at one end. It should be apparent that the bisecting cross member's shape comprises the outer face 13 of two opposing side members 11, joined at the flange 17 of each side member, having a notch 21 running lengthwise along the cross member's upper face as a means for separating the bisecting cross member into two separate, ranged side members 11.

The present invention also makes use of a lip 18 beneath the flange of each side member, whose function was previously described above. When this lip is present beneath the flange on the outer face of each side member, it should also be present in the shape of a separable, bisecting cross member. That is, the bisecting cross member must be formed as described above, essentially comprising two individual, opposing, flanged side members, commonly joined at the tips of each side member's flange wherein the oppositely joined side members each have a lip 18' as described herein above. FIG. 7 provides a view of the bisecting cross member looking at one end having the lip 18' on either side. It should be apparent that separating the bisecting cross member into two flanged side members 11 will further produce the lip 18' desired in each of the side members formed by the separation of the bisecting cross member 20.

Another important embodiment of the invention presents not only a horizontally coffered suspended ceiling, but a vertically coffered suspending ceiling structure as well. The combination of the horizontally placed structures in a grid with vertically oriented structures presents a suspended cubical grid arrangement, shown in FIG. 8. A plurality of integral, hollow, coffered rectilinear structures are first suspended horizontally within a conventional T-bar matrix to form a horizontal, coffered, suspended ceiling grid 19. In addition, a plurality of similarly shaped, integral, hollow, coffered rectilinear structures are fitted in a vertical plane to the horizontal structures so as to form a 3-Dimensional rectilinear structure, such as the cube shown in the present embodiment of FIG. 8 and in the section cut drawings of FIG. 8 shown by FIG. 9. In order to use integral, hollow rectilinear structures in a 3-Dimensional grid pattern, the inventor sought to create a rectilinear structure having dimensions such that any given 2'×4' or 2'×2' rectilinear structure of the present invention as shown in FIG. 2 could be used either in the horizontal or vertical position. Four modifications to the previously described rectilinear structures within a conventional T-bar matrix accomplish these goals. Since the rectilinear structures as described and claimed herein are designed to be used interchangeably as either horizontally oriented structures or as vertically oriented structures within a 3-Dimensional T-bar matrix, the discussions relating to the construction of the rectilinear structure assumes the rectilinear structure is in the horizontally oriented position unless otherwise stated.

The first modification necessary to create a 3-Dimensional T-bar matrix requires that, for any T-bar rail upon which both a vertical and horizontal rectilinear structure must depend for support, the conventional T-bar rail having two horizontally extending half planes **2*a* and 2*b* must be replaced. In its place an angled T-bar rail 34 is installed, having a vertical plane connected at its lower edge to a horizontal plane, as shown in FIG. 9. The angled T-bar rail 34** is suspended from the natural ceiling by cables or other suspending means located so as not to interfere with its function described herein below. Typically, means for suspending the angled T-bar rail may be located at the ends of the rail or between vertically oriented structures resting on it.

Referring back to FIG. 4, the second modification requires the outer, upper corner of flange 17 of each side member 11 in the rectilinear structure be sloped at a 45 degree angle so as to produce a mitered flange 17'. A 45° angled slope in the flange 17 begins approximately from the midpoint of an outer face 21 of the flange 17 and ends approximately at the midpoint of an upper face 22 of the flange 17, as shown by FIG. 4. The mitered flange 17' produces a seating surface 30 so that, when one hollow rectilinear structure 10 is suspended horizontally within the T-bar matrix, with at least one side member being supported by an angled T-bar 34, then a second rectilinear structure 10' having a similarly mitered flange 17' may be suspended vertically by mating the mitered flange of the vertically oriented rectilinear structure 10' with the mitered flange of the side member 11 supported on the angled T-bar 34 of the horizontally oriented rectilinear structure, shown by FIG. 9. The mitered flange 17' of the horizontally oriented structure thus serves as seating surface 30, providing support to the vertically oriented structure 10'.

Mating two structures successfully in perpendicular planes to each other requires a third important modification to the rectilinear structure. The mitered flanges of two perpendicularly oriented structures cannot seat together if the upper half face of each side member obstructs the positioning of the vertical structure's flange onto the horizontal structure's flange, as would happen if the upper half face **13*b* was at a perpendicular angle to the flange. The upper half face 13*b* of each structure must be shaped so as to allow unobstructed positioning of the vertical structure onto the horizontal structure. Thus, the inventor introduced a second mitered angling of the hollow rectilinear structure in the upper half face 13*b* of each side member 11. The mitered upper half face 13*b* produces a sloping of the face away from the flange 17 beginning at the termination point of the flange into the side member. The mitered upper half face continues to slope into the side member 11 such that sufficient material is removed from the upper half face of the structure to allow the mitered flange of a horizontally oriented structure 10 to receive and seat with the mitered flange of a vertically oriented structure 10'. In the preferred embodiment of the invention, as shown in FIGS. 8 and 9, the second mitered angle 31 in the upper half face 13*b* is configured so as to produce a second seating surface 35 at the top of the upper half face. This second seating surface provides additional stability and support to the vertically oriented rectilinear structure shown by FIG. 8**.

A final modification to the T-bar matrix requires installation of an additional means of stabilizing the vertically oriented structures 10' to prevent them from falling out of the matrix. That is, the 3-Dimensional T-bar matrix must be established in the vertical plane as well as in the horizontal plane. This additional means of stabilizing the vertically oriented structures is accomplished by establishing a second, generally horizontal, plane of T-bar rails parallel to and above the conventional, or first, horizontal plane of angled T-bar rails 34 such that the vertically oriented rectilinear structures may seat within and between the first and second horizontal planes of T-bar rails, as shown in FIG. 8, to create a 3-Dimensional suspended cubical grid pattern. Like the embodiments of a conventional T-bar matrix, a vertical T-bar matrix also requires identical main runner members generally parallel to each other, and cross runner members generally parallel to one another and perpendicular to the main runner members. However, unlike the conventional T-bar matrix wherein the main and cross runner members consist of identically manufactured T-bar rails, in the vertical T-bar matrix, the main runner members in the second horizontal plane preferably consist of angled T-bar rails 34, disclosed above. The main runner members 34 in the first and second horizontal planes and further referred to as lower runner members and upper runner members. Since the lower runner member, or angled T-bar rail 34, provides most of the support for a vertically oriented structure, while the upper runner member 36 need only present a means for providing stability and limited support to the vertically oriented structure. As shown in FIG. 8, the upper runner member 36 is preferably, an angled T-bar rail 34, but could also be a conventional T-bar rail 2. The cross runner members in the vertical plane are vertically situated between the upper and lower runner members. The cross runner members consist of the conventional (inverted) T-bar rails, disclosed above.

The integral, hollow rectilinear structures described above for use in a 3-Dimensional T-bar matrix should also be sized so as to produce a coffered and consistent appearance in either the horizontal or vertical planes. Preferably, the rectilinear structures will be sized to project out, or away from, the T-bar rail a distance of 3 to 7 inches, in either or both the horizontal and vertical planes. Further, the flanges of the integral hollow rectilinear structures in the 3-Dimensional T-bar matrix should extend sufficiently far so as to engage substantially all of the protruding plane of either the conventional half-plane T-bar rail or of the angled T-bar rail.

In one embodiment, the side members of the rectilinear structures in the 3-Dimensional T-bar matrix should also be able to accommodate a track assembly mounted to the T-bar rail, similar to the track assembly described herein above. As shown by FIGS. 3 and 4, a lip 18 beneath flange 17 is formed in the side member 11 to create a rectilinear space beneath flange 17. When two opposing rectilinear structures 10 of the 3-Dimensional T-bar matrix are seated horizontally on respective half-planes **2*a* and 2*b* of a conventional T-bar rail within the 3-Dimensional T-bar matrix, the opposing lips 18 of both side members 11 cooperate to form, or reveal, a rectilinear space sufficiently wide to receive a track assembly for mounting directly to and beneath a T-bar rail. Each lip 18 is equally sized to present a space centered beneath the T-bar rail. Sizing of each lip is chosen to be wide enough to receive the track assembly while also maintaining a flush fit of the assembly to the lower half face 13*a* of each opposing side member 11**.

In another embodiment, the rectilinear structures of a 3-Dimensional T-bar matrix will optionally have a plurality of cross members spanning the interior of the hollow rectilinear structure for forming a geometrical grid pattern, or lattice. The rectilinear structures of the 3-Dimensional T-bar matrix could also be constructed so as to have a single, bisecting cross member, previously described above. The bisecting cross member would be formed similarly to those described above. Specifically, the bisecting cross member is symmetrically shaped so as to comprise the outer face 13 of two opposing side members 11, joined at the flange 17 of each side member. In the case of a rectilinear structure constructed for use in a 3-Dimensional T-bar matrix, the opposing, joined side members comprising the symmetrically shaped bisecting cross member have the additional mitered flange 17' and second mitered angling 31 of the hollow rectilinear structure in the upper half face **13*b* of side member 11, as described earlier. The bisecting cross member for the 3-Dimensional rectilinear structure may also have a notch 21 running lengthwise along the cross member's upper face as a means for separating the bisecting cross member into two flanged side members 11. Thus, a 2'×4' 3-Dimensional rectilinear structure may also be separated along the center of the bisecting cross member into two smaller, 2'×2' rectilinear structures and installed either in a horizontal plane or vertical plane of a 3-Dimensional T-bar matrix. Preferably, the means for separating the bisecting cross member is a notch running centrally along the top of the bisecting cross member having sides sloped at approximately 45 degree angles to form a "V" notch, as shown by FIG. 7**. This allows the bisecting cross member to separated along the notch to create two separate flanged rectilinear structures. Further, the angles of the "V" notch become seating surfaces in the newly formed flanges of each side member resulting from the separation of the bisecting cross member, wherein the seating surfaces are mitered angles in the flange, rising from the outer faces of the flanges and ending at the upper faces of the flanges. Thus, a "V" notch in the bisecting cross member serves dual purposes to both allow a means for separating the cross member and then, after separation, the angled, split "V" surface is a mitered flange in each new side member, forming the angled seating surface needed for joining two rectilinear structures in perpendicular planes to each other to form a 3-Dimensional T-bar matrix. Finally, it's desirable that the bisecting cross member be formed with a lip beneath the flange on each side of the cross member so that, when it is split into two individual side members, each side member may be placed on a conventional T-bar rail (not an angled T-bar rail) and the lip of the side member will cooperate with the opposing side member of the conventional T-bar rail to reveal a space for accommodating an additional track assembly which can be mounted to, and beneath, the conventional T-bar rail.

These and other alternatives, derivatives and substitutions which may become apparent to those of skill in the art without departing from the spirit and principles of the matter disclosed and claimed herein are intended to be encompassed within the scope of the invention.

The embodiments of the invention in which an exclusive property or privilege is claimed are defined as follows:

1. Rectilinear structure for suspension either in a vertical plane or in a horizontal plane from T-bar rails so as to create a 3-Dimensional grid pattern formed by a plurality of rectilinear structures in the vertical and horizontal planes, each rectilinear structure comprising:

(a) four side members formed together so as to create an integral, hollow rectilinear structure, each side member having an outer face, each outer face of the side member further having an upper half face;

(b) a flange projecting outward from and along the outer face of each side member so that the flange may engage an extending half plane of a T-bar rail for supporting the rectilinear structure, the flange further having an upper and an outer face;

(c) a slope in the flange having an angle of approximately 45 degrees rising approximately from the midpoint of the outer face of the flange and ending at approximately the midpoint of the upper face of the flange, the slope thereby forming a seating surface; and (d) an oblique angle in the upper half face of the side member from a point at which the upper face of the flange meets the upper half face of the side member so that a horizontal rectilinear structure supported by and resting within T-bar rails may accept and support a second vertical rectilinear structure constructed identically to the horizontal rectilinear structure and inserted perpendicularly to the horizontal rectilinear structure, wherein the seating surface of the flange of the horizontal rectilinear structure meets with the seating surface of the flange of the vertical rectilinear structure, and wherein the oblique angles of both rectilinear structures allow each horizontal and vertical rectilinear structure to be oriented perpendicularly to one another such that each horizontal and vertical rectilinear structure are perpendicular to one another, whereby a plurality of horizontal rectilinear structures may support a plurality of vertical rectilinear structures to therefore create a 3-Dimensional cubical of rectilinear structures for suspension within T-bar rails.

2. The structure of claim 1, wherein the hollow rectilinear structures are sized to project out preferably from 3 to 7 inches away from the T-bar rail suspending them so as to form a 3-Dimensional coffered ceiling grid.

3. The structure of claim 1 wherein the flange extends outward from each side member so as to engage substantially all of an extending plane of a T-bar rail in the 3-Dimensional T-bar matrix.

* * * * *